US007552682B2

(12) United States Patent
Schwantes et al.

(10) Patent No.: US 7,552,682 B2
(45) **Date of Patent: *Jun. 30, 2009**

(54) ACCELEROMETER MOUNTING FOR A PENETRATOR AND METHOD THEREOF

(75) Inventors: Stanley N. Schwantes, Golden Valley, MN (US); Bradley M. Biggs, Sahuarita, AZ (US); Michael A. Johnson, Chaska, MN (US)

(73) Assignee: Alliant TechSystems Inc., Minneapolis, MN (US)

( * ) Notice: Subject to any disclaimer, the term of this patent is extended or adjusted under 35 U.S.C. 154(b) by 37 days.

This patent is subject to a terminal disclaimer.

(21) Appl. No.: 11/613,497

(22) Filed: Dec. 20, 2006
(Under 37 CFR 1.47)

(65) Prior Publication Data

US 2008/0148984 A1 Jun. 26, 2008

(51) Int. Cl.
*C06C 7/00* (2006.01)
*F42C 19/06* (2006.01)
*F42C 9/14* (2006.01)

(52) U.S. Cl. ..... 102/275.9; 102/216; 102/265; 102/271; 102/200

(58) Field of Classification Search ..... 102/216, 102/265, 266, 271, 396, 473, 499
See application file for complete search history.

(56) References Cited

U.S. PATENT DOCUMENTS

| | | | | |
|---|---|---|---|---|
| 4,622,730 | A | 11/1986 | Steinbock | |
| 4,915,028 | A | 4/1990 | Apotheloz | |
| 5,325,784 | A * | 7/1994 | Bai et al. | 102/293 |
| 5,454,321 | A * | 10/1995 | Biggs et al. | 102/219 |
| 5,585,592 | A * | 12/1996 | Stearns et al. | 102/233 |
| 5,705,766 | A * | 1/1998 | Farace et al. | 102/215 |
| 5,939,662 | A * | 8/1999 | Bootes et al. | 102/473 |
| 6,523,477 | B1 | 2/2003 | Brooks et al. | |
| 7,357,081 | B2 * | 4/2008 | Zinell et al. | 102/245 |
| 2003/0140811 | A1 | 7/2003 | Bone | |
| 2004/0163564 | A1 * | 8/2004 | Sutcliffe | 102/266 |
| 2006/0090662 | A1 | 5/2006 | Biggs | |
| 2007/0039454 | A1 * | 2/2007 | Gibson et al. | 89/1.1 |
| 2007/0051266 | A1 * | 3/2007 | Zinell et al. | 102/237 |

OTHER PUBLICATIONS

Brian Glowacki, Aviation Ordnanceman, Nonresident Training Course, US Navy, Jul. 2001, Chapter 1.*
Glowacki, Aviation Ordnanceman, Nonresident Training Course, US Navy, Jul. 2001, Chapter 1.

* cited by examiner

*Primary Examiner*—James S Bergin
*Assistant Examiner*—Michael D David
(74) *Attorney, Agent, or Firm*—TraskBritt PC

(57) ABSTRACT

A fuze for a weapon configured as a projectable device is provided to reduce the mechanical amplification of impact and penetration shock to a fuze-mounted accelerometer when a projectable device including the fuze encounters a target. The fuze includes a fuze housing having an outer surface, a flange extending radially from the outer surface of the fuze housing, and an acceleration sensor connected to the flange. The flange may include one or more axial holes to enable attachment of the fuze to a projectable device. A penetrating weapon projectable device and a method for installing a fuze for a projectable device are also provided.

31 Claims, 4 Drawing Sheets

ACCELEROMETER MOUNTING FOR A PENETRATOR AND METHOD THEREOF

CROSS-REFERENCE TO RELATED APPLICATIONS

The present invention is related to application Ser. No. 11/613,441 entitled "FUZE MOUNTING FOR A PENETRATOR and METHOD THEREOF" filed simultaneously herewith, the disclosure of which is incorporated by reference herein.

FIELD OF INVENTION

The present invention, in several embodiments, relates generally to a fuze for weapons and, more particularly, to an accelerometer mounting upon a bolted flange fuze for a penetrating type weapon configured as a projectable device and used to detect media layers in an effort to locate and destroy sheltered targets, including a method thereof.

BACKGROUND OF INVENTION

In military operations, targets may be generally classified as either sheltered targets or sheltered targets. Unsheltered targets may be considered to include targets that are substantially exposed and vulnerable to weapons, including projectable devices fired by artillery directed at such targets. Such projectable devices include, without limitation, artillery shells and rocket-launched projectiles. For example, people, munitions, buildings and other fighting equipment that are openly located on a battle field and substantially exposed to the weapons of an enemy attack may be considered unsheltered targets.

However, many targets including, for example, people, munitions, chemicals, and fighting equipment may be sheltered in order to protect them from an attack by various weapons. Conventionally, a shelter for a target includes a physical barrier placed between the target and the location of origin of an expected enemy weapon in an attempt to frustrate the weapon directed at the target and prevent or mitigate the damage that might otherwise be inflicted by such a weapon. In some cases, targets may be heavily sheltered in an attempt to prevent any damage to a given target. In one example, one or more layers of concrete, rock, soil, or other solid material may be used in an effort to protect a desired target. Each layer may be several feet thick, depending on the level of protection desired. Sometimes these layers are referred to as shards layers, the term "hard" indicating a relative amount of resistance that they will impose on an incoming projectable device of a weapon system. Generally, a layer is considered to be "hard" when it exhibits a specified level of thickness, when it is formed of a material exhibiting a specified level of hardness or some other material characteristic which significantly impedes penetration of a projectable device, or when the layer exhibits a desired combination of material properties and physical thickness.

In order to penetrate shelters, and particularly a hard layer (or layers) of a given shelter, a weapon system using a projectable device configured with a penetrator system is conventionally used. The general goal of using a penetrator system is to breach the shelter, including any thick layers that may be present, and deliver the projectable device to a desired location (i.e., proximate the intended target) while delaying detonation of the explosive carried by the projectable device until it is at the desired locations. Thus, use of a penetrator system enables a more efficient and a more effective infliction of damage to a sheltered target and, sometimes, use of such a system is the only way of inflicting damage to certain sheltered targets.

A penetrator system is part of a weapon system that may employ one or more projectable devices in the form of warheads, a penetrator structure (generally referred to as a penetrator) and a sensor (such as an accelerometer) associated with and coupled to the penetrator. The penetrator may be configured to act as a warhead, or it may be a separate component, but generally includes a mass of relatively dense material. In general, the capability of a penetrator to penetrate a given layer of media is proportional to its sectional density meaning its weight divided by its cross-sectional area taken along a plane substantially transverse to its intended direction of travel. The weapon system may include equipment for guiding the projectable device to a target or, at least to the shelter, since, in many cases, forces associated with impact and penetration of a shelter may result in the removal of such guidance equipment from the penetrator portion of the projectable device. The sensor of a penetrator system is conventionally configured to assist in tracking the location of the penetrator as it penetrates layers of one media type or another after an initial impact of the weapon projectable device and, thus of the penetrator, with the shelter.

Various conventional penetrator systems have been employed with some degree of success. In some conventional penetrator systems, a sensor is used to detect an initial impact with a structure. The system then monitors the amount of time that has elapsed subsequent to the detected impact in an effort to keep track of the location of a penetrator, based on calculated or estimated velocity of the weapon, as the penetrator penetrates a shelter. Such systems are sometimes referred to as time-delay systems.

Other conventional penetrator systems utilize one or more sensors, such as an accelerometer, to measure the deceleration of the penetrator. The system then tracks the distance traveled by the weapon, from the time of the initial impact with a layer of a shelter or structure, in an effort to determine the projectable device's projected location with the shelter or structure. These systems are generally referred to as penetration depth systems.

Some conventional penetrator systems utilize an accelerometer to detect deceleration of the projectable device responsive to contact with relatively hard and/or thick layers in an effort to help count the layers of media, count voids between the layers of media, or count both media layers and voids so as to determine the projectable device's substantially instantaneous location within a particular structure.

Such conventional penetrator systems provide an output signal for initiating explosive or other energetic material carried by the projectable device after the penetrator system has determined that the projectable device has arrived at a desired location within the shelter. Desirably, the initiation of the explosive or other energetic material occurs at a target site, such as within a specified room of a bunker. However, in practice, any of a number of factors may result in the miscalculation of a projectable device's projected location within a shelter and, therefore, initiation of the explosive or other energetic material at an undesired location. Such factors may include, for example, variability in the physical or material characteristics of a given layer.

One particular issue faced by conventional penetrator systems includes the ability to detect so-called thin layers. While penetrator systems have been used to detect decelerations that result from contact of the projectable device with a relatively thick or hard layer, such penetrator systems have not been effective in accurately detecting and, thus accounting for, layers that are thin, soft, or some combination thereof, due to the relatively low amount of deceleration experienced by the projectable device when passing through such thin or soft layers. Some examples of "thin" layers include ceilings and floors in buildings that may be located over a target. Some examples of "soft" layers include layers of sand or other soft soil. Generally, a layer is too thin or too soft to detect when the deceleration of a penetrating weapon, as it passes through such a layer, cannot be discriminated from electrical noise, mechanical noise, or a combination of electrical and mechanical noise experienced by the sensor. Therefore, there is a desire to eliminate isolate or reduce noise experienced by a penetrator sensor in order to provide better reliability of and indication from the sensor signal, regardless of the characteristics of material layers (a thick, thin, hard or soft, including voids) encountered by the projectable device.

Some conventional penetrator systems have utilized gain switching in an effort to detect relatively thin layers. Cain switching generally includes use of a high gain amplifier to detect low levels of deceleration by the projectable device and use of a lower gain amplifier as deceleration of the projectable device increases. Such gain switching may occur between a computer sampling of the projectable device's deceleration. Gain switching may generally be accomplished using one or more amplifiers, one or more analog-to-digital converters, or some combination thereof. Nevertheless, such systems are less effective in detecting layers that are of a thinness exhibited in numerous targets such as the thin roofs and floors of many buildings because the signal, although amplified, must still be discernable over noise, such as impact amplification noise. Therefore, it is also desirable to reduce noise to a sensor to improve the sensitivity of penetrator systems.

Some conventional penetrator systems have actually attempted to avoid detection of thin layers so that the attendant errors in detecting soft or thin layers do not "confuse" the system and result in the untimely initiation of the explosive or other energetic material carried by the projectable device. For example, some attempts have been made to adjust the sensor thresholds of a penetrator system so that they only detect so-called "hard" layers and effectively ignore all thin or soft layers of a shelter. However, such attempts unfortunately result in the sensor ignoring a layer that may be significant to a well-timed detonation such as, for example, the ceiling of a hunker, again resulting in the detonation of the energetic material carried by the projectable device at an undesired location.

In other conventional penetrator systems, attempts have been made to not only ignore thin layers, but to prevent the system from erroneously counting a single layer as more than one layer. To do so, such penetrator systems have used a programmed distance, sometimes referred to as a "blanking distance," to ignore both false layers and real layers after the penetrator system has detected a deceleration of the projectable device. In one example, a conventional penetrator system would calculate and measure the blanking distance traveled by the projectable device based on the penetration velocity of the penetrator system at the time of its impact with a layer and the time that expired after such impact. Some other penetrator systems have also used the deceleration values and the detection of an exit of the projectable device from a penetrated layer to help determine the blanking distance.

Yet another system entitled "Method for detection of media layer by a penetrating weapon and related apparatus and systems," by one of the inventors herein, published May 4, 2006 as United States Patent Application number 20060090662, the disclosure of which is incorporated by reference herein, provides a method of locating a penetrating-type weapon within a shelter. The method includes projecting the projectable device through a layer of media and detecting a weapon frequency induced by vibration of the projectable device. A harmonic frequency of the weapon frequency is analyzed to determine, for example, whether a deceleration event has occurred. Analysis of the harmonic frequency of the weapon frequency may include determining whether the amplitude of the harmonic frequency meets or exceeds a defined minimum amplitude. In order to improve the robustness and accuracy of determining the amplitude of the harmonic frequency determined, a sensor of a penetrator system, for example, an accelerometer, would benefit from improved vibration, acceleration and deceleration sensing while being less susceptible to noise caused by impact or penetration shock amplification. Therefore, there is a further desire to improve vibration or acceleration sensing by providing a sensor of a penetrator system that is less susceptible to impact or penetration shock amplification.

What has been observed of penetrating weapons configured as projectable devices during testing is that the impact and penetration of the projectable device, may result in a shock capable of degrading or destroying the accelerometer, electronics, explosive initiators and explosives in the fuze or fuze well. It is further contemplated that the impact and penetration shock, experienced by the projectable device, mechanically amplifies the acceleration effect upon the accelerometer or sensor. Therefore, it is an additional desire to provide an attachment that efficiently locks, reliably loads and robustly secures a sensor, such as an accelerometer, of an installable fuze into a fuze well of a projectable device in order to minimize shock amplification in the accelerometer at impact and during penetration of a projectable device into a desired target.

Accurate detection and recognition of soft, hard, thin or thick layers is desirable in many applications using an installable fuze having a sensor and associated electronics therein. As such, there is a continued desire to improve the penetrator systems used in projectable devices of weapon systems so as to increase their accuracy in determining their arrival at a desired location by eliminating or reducing noise affecting the sensor's detection capabilities, particularly caused by mechanical amplification experienced at impact and during penetration.

Accordingly it is desirable to eliminate, isolate or reduce the noise experienced by the sensor in order to provide better reliability of and indication from the sensor signal, regardless of the projectable device passing through a thick, thin, hard or soft material layer (including voids). It would also be of advantage to reduce noise to a sensor to improve the sensitivity of penetrator systems. Of further advantage would be to improve vibration or acceleration sensing by providing a sensor of a penetrator system for use in a projectable device that is less susceptible to impact or penetration shock amplification.

BRIEF SUMMARY OF THE INVENTION

Accordingly, in embodiments of the invention, a fuze for a projectable device of a weapon system is provided to reduce the mechanical amplification of impact and penetration shock to a fuze-mounted accelerometer when a projectable device including the fuze encounters a target. The fuze includes a fuze housing having an outer surface, a flange extending radially from the outer surface of the fuze housing, ad an acceleration sensor connected to the flange. The flange may include one or more axial holes to enable attachment of the fuze to a weapon projectable device. A projectable device and a method for installing a fuze for a projectable device of mounting an accelerometer on a fuze are also provided.

A penetrating weapon configured as a projectable device and a method for installing a fuze for a projectable device are also provided.

Other advantages and features of the invention will become apparent when viewed in light of the detailed description of the various embodiments of the invention when taken in conjunction with the attached drawings and appended claims.

DETAILED DESCRIPTION OF THE INVENTION

In an embodiment of the invention, the mounting location for the accelerometer in the aft end of the fuze housing advantageously improves void/layer detection by reducing the effect of warhead fill sloshing during penetration; may improve depth of burial and function distance accuracies by reducing projectable device vibration and shock to the accelerometer; and may increase shock survivability of the accelerometer by reducing effects caused by conventional cantilevering in the fuze. Moreover, the inventive mounting location for the accelerometer in the fuze housing allows for installation and checkout verification of the accelerometer after the fuze electronics and explosives are installed, enabling a defective accelerometer to be replaced without removing the fuze electronics and or explosives.

In embodiments of the invention, an accelerometer mounting for a penetrator configured as a projectable device is provided for reduction of mechanical amplification caused by impact or penetration shock. Moreover, the accelerometer mounting reduces the mechanical noise experienced by the sensor to provide better reliability and indication of the signal produced thereby responsive to the penetrator passing through thick, thin, hard or soft material layers. In yet another embodiment of the invention, a fuze includes a fuze housing having an outer surface, a flange extending radially from the outer surface of the fuze housing, and an acceleration sensor directly connected to the flange. The flange includes one or more axial holes to enable attachment of the fuze to a fuze well of a weapon projectable device.

In other embodiments of the invention, an accelerometer is mounted on a flange of a fuze to reduce mechanical amplification cause by impact or penetration shock where the fuze includes sensitive electronic components for controlling the firing point of a penetrating weapon configured as a projectable device. In still another of the embodiments of the invention, mechanical filters like a foam pad, potting or other mechanical filters are used to shock-isolate the accelerometer. The invention improves sensor capabilities by enabling the generation of a sensor output signal less susceptible to interference by mechanical noise, which signal may be utilized by a processor suitably programmed with deceleration sensing weapon algorithms to provide more accurate, unmodified emulation of the deceleration experience by the accelerometer. Moreover locating the accelerometer upon the mounting flange of the fuze provides improved sensing of the projectable device's actual acceleration.

Figure 1:
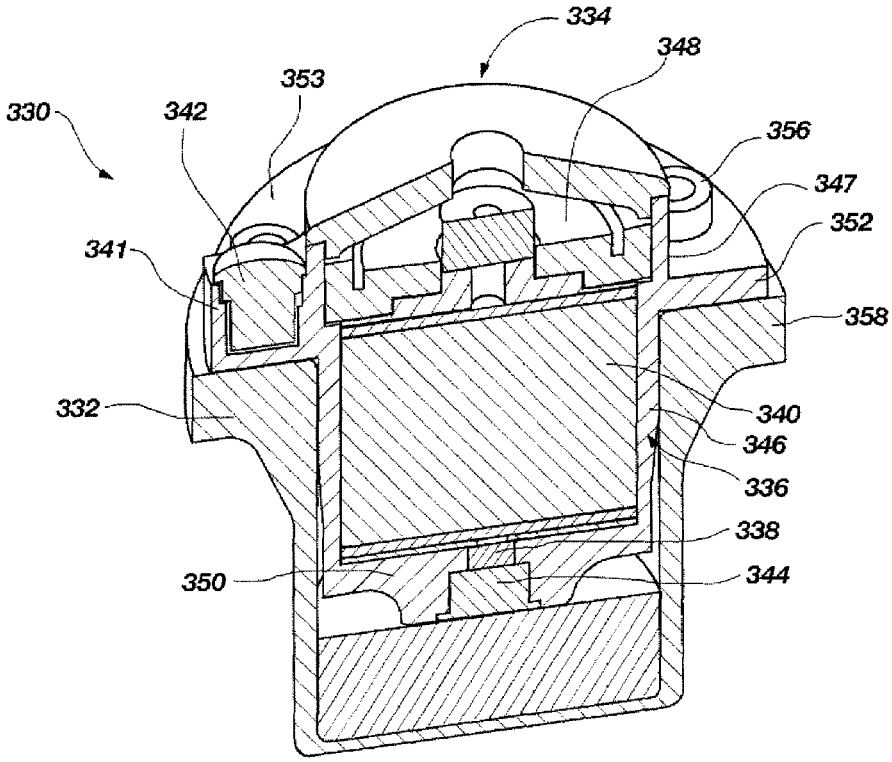
FIG. 1 shows a cross-sectional view of an accelerometer mounting for a fuze in accordance with an embodiment of the invention.

Referring to FIG. 1, an accelerometer mounting 330 for a fuze 334 is shown in accordance with an embodiment of the invention. The fuze 334 includes a fuze housing 336 for receiving the components, such as an exploding foil initiator ("EFI") 338, fuze electronics 340, a fuze accelerometer or acceleration sensor 342, and a lead charge 344 to name a few, without limitation. Conventionally, the components within the fuze 334 other than a flange-mounted accelerometer are installed and potted in accordance with customary practice known to one of ordinary skill in the art.

The fuze housing 336 includes a wall 346 that is generally cylindrical having an aft end 348 and a front end 350. While the fuze 334 is generally cylindrical, other shapes, including conic or rectilinear shapes, may be utilized advantageously in order to be consistent with the scope of the invention. The aft end 348, in this embodiment, is a separate material piece that is removably connectable to the wall 346 by threads (not shown), such that the components of the fuze 334 may be installed therein. However, it is recognized that the aft end 348 may be integrally formed with the wall 346 or may be a separate material piece that is removably connectable to the wall 346 by bolting or a locking, for example, without limitation. The front end 350, in this embodiment, is integrally formed with the opposite end of the wall 346 providing a unitary construction that is less susceptible to mechanical amplification than if constructed from two or more attached parts for a given design envelope. However, like the aft end 348, the front end 350 may be secured to the wall 346, by welding, bolting or a lock ring, for example, without limitation. The front end 350 and the aft end 348 may include openings or recesses to facilitate mounting of the components of fuze 334 therein or to facilitate proper operation of the fuze 334.

The wall 346 of the fuze 334 further includes an integral bolted flange 352 that extends annularly around an outer surface 347 of the wall 346. The flange 352 in this embodiment is located at the aft end 348 of the wall 346, but it is recognized that the flange 352 may radially extend about the outer surface 347 of the wall 346 while being positioned anywhere along the axial direction of the wall 346. The flange 352 includes mounting holes (not shown, reference may be made to mounting holes 54 shown in FIG. 3) for receiving a like number of fasteners 356. The fasteners 356 are securable to fuze well threaded holes (not shown, reference may be made to threaded holes 57 shown in FIG. 3) symmetrically positioned about an aft closure plate or flange seating portion 358 located on fuze well 332. The fasteners 356 rigidly secure the flange 352 of the fine 334 to the flange seating portion 358 of the fuze well 332. In this regard, the fasteners 356 enable the direct coupling of the fuze 334 with the fine well 332, to eliminate or reduce mechanical amplification that would otherwise be caused by multiple mechanical interfaces as described above with respect to conventional fuze mounting structures. With sufficient loading by the fasteners 356, the flange 352 and seating portion 358 provide a nearly unitary connection that exhibits a substantially reduced susceptibility to mechanical amplification to acceleration and deceleration forces.

The flange 352 further includes an accelerometer housing or mount 341 for receiving the accelerometer or acceleration sensor 342. The accelerometer mount 341 is located upon the aft face 353 of the flange 352, and allows for the axial mounting of the accelerometer or acceleration sensor 342 and proper installation of its electrical leads (not shown) to the fuze electronics 340. While the mounting location of the accelerometer or acceleration sensor 342 is significant to the invention, a person of skill in the art will be capable of properly routing and connecting the electrical leads. As will be discussed below, shock amplification to the accelerometer or acceleration sensor 342 is at minimum levels where the fuze 334 is mounted to a warhead or penetrator 332 in accordance with embodiments of the invention. The accelerometer mount 341 provides a protective barrier to the mounted accelerometer or acceleration sensor 342. While the accelerometer mount 341 is integral with the fuze housing 336 in this embodiment, it is recognized that the accelerometer mount 341 may be a separate, directly securable part. Moreover, the accelerometer or acceleration sensor 342 itself may be directly mounted to the flange 352 eliminating the need for the accelerometer mount 341

Optionally, the accelerometer mount 341 may include mechanical filters like a foam pad or potting (not shown), for example, without limitation, to shock isolate the accelerometer or acceleration sensor 342 or to allow tuning adjustment for different accelerometer package sizes or weights.

Figure 2:
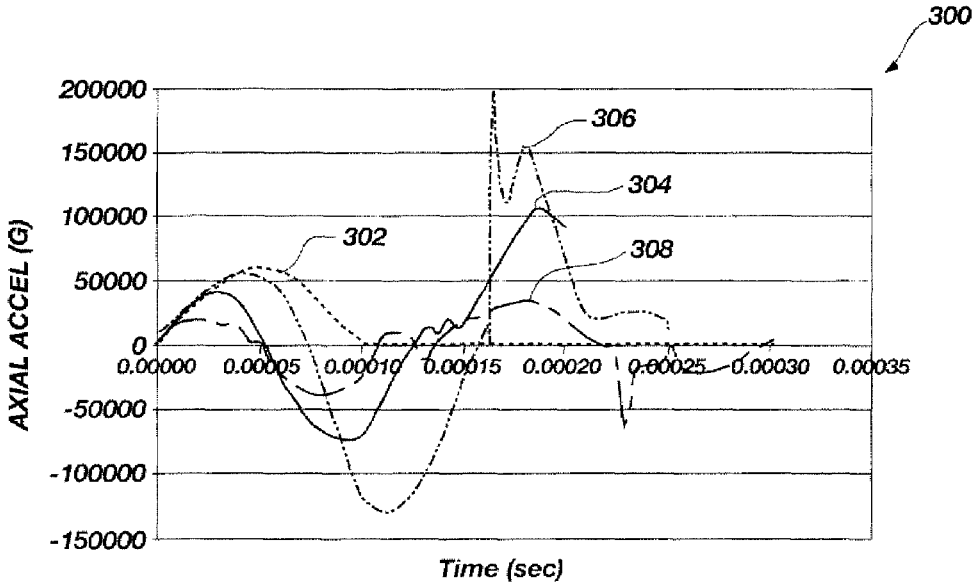
FIG. 2 is a graph of axial acceleration for three different fuze types in response to an input shock.

Additional performance improvement obtained through use of an embodiment of the invention is shown in FIG. 2 and Table 1. FIG. 2 is a graph 300 of axial acceleration for three different fuze types in response to an input shock 302. The graph 300 includes a vertical axis indicating axial acceleration in Gs in meters per second squared, and a horizontal axis indicating elapsed time in seconds. The input shock 302 consisted of a 60,000 G half-sine shock pulse for 100 microseconds applied in the axial direction for each fuze type. Response 304 is for an HTSF fuze configuration secured to the warhead or penetrator sandwiched by a fuze locking ring with the accelerometer mounted therein. Response 306 is for an MEHTF fuze configuration secured to the warhead or penetrator sandwiched by a fuze locking ring with the accelerometer mounted therein. Response 308 is for a flange-mounted accelerometer in accordance with an embodiment of the invention, the flange being secured to the warhead with a bolted flange. Responses 304, 306 and 308 are as observed at the accelerometer mounting location. As is shown in FIG. 2, improved mechanical amplification reduction, in comparison to conventional designs is achieved at the accelerometer by providing an accelerometer mounting design to secure the accelerometer to the fuze to the penetrator. The results are tabularized in Table 1, which shows the shock amplification of an accelerometer for each fuze type. Table 1 also includes results for the shock amplification of the accelerometer for the fuze shown in FIG. 3.

TABLE 1

Shock amplification of the accelerometer in the fuze mounting.

| Fuze Type | Shock amplification of accelerometer (unitless) |
|---|---|
| MEHTF | −2.2/+3.3 |
| HTSF | −1.3/+2.0 |
| Bolted flange with integral aft cover and accelerometer mounted therein (FIG. 3) | −1.4/+1.4 |
| Bolted flange having an accelerometer mounted therein, with integral front cover (FIG. 1) | −0.7/+1.0 |

Figure 3:
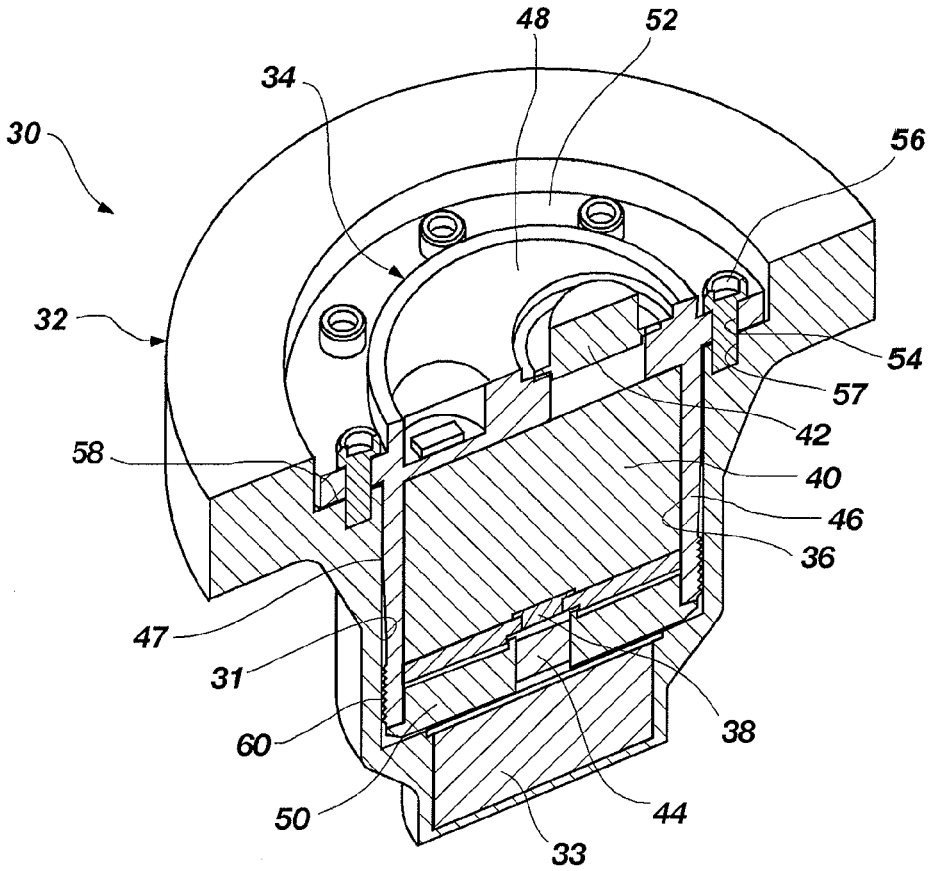
FIG. 3 shows a cross-sectional view of a fuze mounting suitable for use with the invention.

The first set of numbers in each row of the shock amplification of accelerometer column of Table 1 represents amplification of deceleration and the second set of numbers represents amplification of acceleration. As depicted, the accelerometer of the conventional MEFTS five type is subject to 2.2 amplification of deceleration and is subjected to 3.3 amplification of acceleration due to the shock input. The accelerometer of the conventional HTSF fuze type is subject to 1.3 amplification of deceleration and is subjected to 2.0 amplification of acceleration due to the shock input. In comparison, the bolted flange connection having an integral aft cover with accelerometer mounted therein, as described below in FIG. 3, is subjected to a lower 1.4 amplification of deceleration and is subjected to 1.4 amplification of acceleration due to the shock input, while the bolted flange connection having an integral front cover and an accelerometer mounted in the flange has markedly improved 0.7 amplification of deceleration and a vastly improved 1.0 amplification of acceleration. Accordingly, the accelerometer mounting in accordance with embodiments of the invention exhibits an optimized amplification of acceleration of less than 2.0.

In accordance with embodiments of the invention, the accelerometer mounting exhibits higher performance by having an amplification of acceleration of less than 1.4, with even better performance by having an amplification of acceleration of less than 1.0.

In accordance with embodiments of the invention, the accelerometer mounting exhibits an optimized combined amplification of deceleration and acceleration of less than −1.3 and 2.0, respectively. The accelerometer mounting may further exhibit higher performance by having an improved amplification of deceleration and acceleration of less than −1.4 and 1.4, respectively, with even better performance by having an amplification of deceleration and acceleration of less than −0.7 and 1.0, respectively. Accordingly, shock survivability of the accelerometer may be improved by minimizing mechanical amplification of impact and penetration shock by providing an improved mounting.

Figure 4:
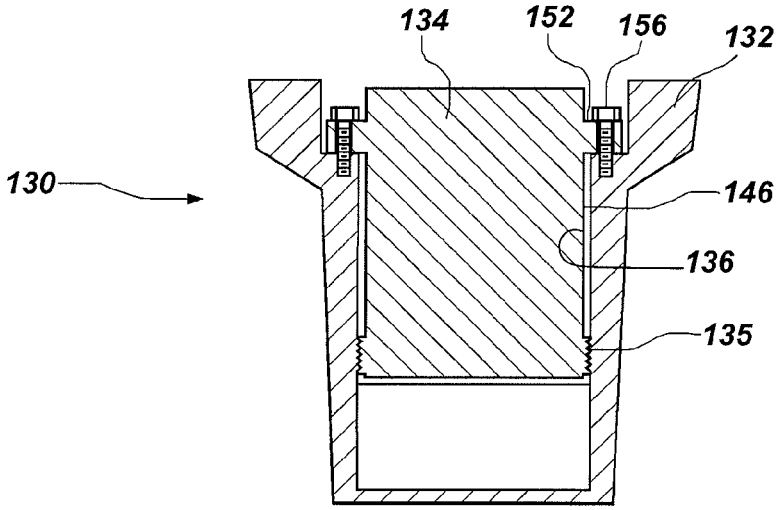
FIG. 4 shows a cross-sectional side view of a fuze mounting suitable for use with the invention.
Figure 5:
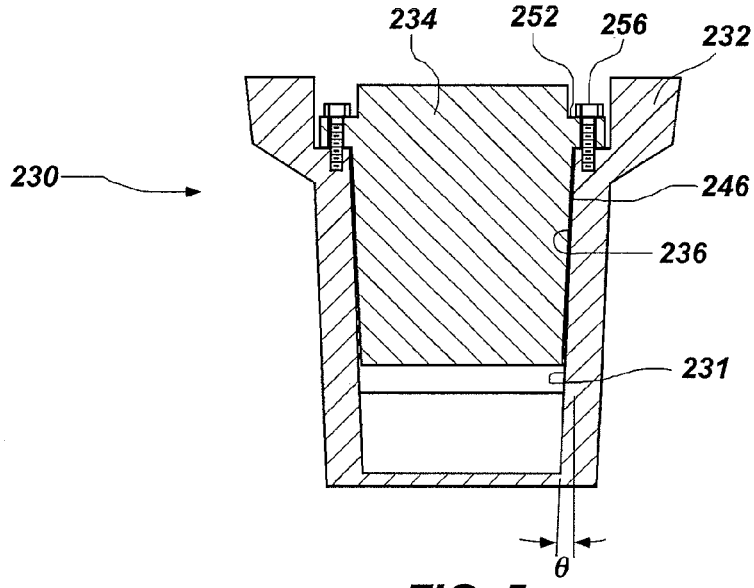
FIG. 5 shows a cross-sectional side view of a fuze mounting suitable for use with the invention.

The mounting of the acceleration sensor for improved responsiveness is intricate with and influenced by the fuze to which it is mounted. In this regard, the mounting of the fuze to the fuze well may affect the performance of the acceleration sensor. Accordingly, fuze mountings 30, 130 and 230 as shown in FIGS. 3, 4 and 5, respectively, are now presented. It is noted that an acceleration sensor is not shown in either FIG. 4 or 5, while an acceleration sensor is shown in FIG. 3 coupled to an aft end 48 that is integrally formed with the wall 46 of the fuze housing 36. However, the acceleration sensor is to be mounted to the fuze in accordance with the invention. Accordingly, the fuze mountings 30, 130 and 230 are presented to provide additional features that may be utilized together with the invention and to provide additional benefit thereto and appreciation thereof.

Turning now to the fuze mountings 30, 130 and 230 shown in FIGS. 3-5, respectively, FIG. 3 shows a fuze mounting 30 suitable for use with the invention. The fuze mounting 30 is suitable for use with any kind of weapon projectable device including a penetrating warhead. The fuze mounting 30 includes a fuze well 32 having a receiving well or port 31 configured for receiving a fuze 34 therein. It is noted that the fuze 34 is ideally receivable into the fuze well 32 such that its installation may occur at an opportune time, such as on a battlefield or just prior to arming of a weapon, to provide for the necessary attachment required for detonation while maintaining separate storage of the fuze 34 and a projectable device for safety. In this regard, the fuze 34 may also be removed from the fuze well 32, if required. The fuze well 32 includes, in this embodiment, a booster charge 33 for accelerating a blast of an explosive or other energetic material located within the weapon (not shown).

The fuze 34 includes a fuze housing 36 for receiving the components thereof, such as an exploding foil initiator ("EFI") 38, fuze electronics 40, fuze acceleration sensor 42, and lead charge 44, etc., without limitation. Conventionally, the components within the fuze 34 are securely fastened and then potted in accordance with customary practice known to one of skill in the art. As embodiments of the invention, as disclosed and claimed herein, are directed to accelerometer mounting, including aspects of the fuze mounting, no further discussion is made regarding the other components contained within the fuze 34 and the description that follows will focus primarily upon the fuze mounting and the accelerometer mounting, including the use and characteristics thereof.

The fuze housing 36 includes a wall 46, an aft end 48 and a front end 50. The wall 46 is generally cylindrical, having two ends. While the fuze 34 is generally cylindrical, other shapes, including conic or rectilinear shapes, may be utilized advantageously in order to be consistent with the scope of the invention. The aft end 48, in this embodiment, is integrally formed with the wall 46. However, it is recognized that the aft end 48 may be a separate material piece that is removably connectable to the wall 46 by threads, bolting, or a lock ring for example, without limitation. The front end 50, in this embodiment, is secured to the opposite end of the wall 46 by threads, such that the components of the fuze 34 may be installed therein. However, like the aft end 48, the front end 50 may be secured by welding or may also be integral with the wall 46, for example, without limitation. The front end 50 and the aft end 48 may include openings or recesses to facilitate mounting of the components of fuze 34 therein or to facilitate proper operation of the fuze 34 during abnormal or upset conditions, as is understood by those of ordinary skill in the aft.

The fuze housing 36 of the face 34 further includes an integral bolt flange 52 that extends annularly around an outer surface 47 of the wall 46. The flange 52 in this embodiment is located at the aft end 48 of the wall 46, but it is recognized that the flange 52 may radially extend about the outer surface 47 anywhere along the axial direction of the wall 46. The flange 52 includes mounting holes 54 for receiving a like number of fasteners 56. The fasteners 56 are securable to threaded holes 57 of the fuze well 32, symmetrically positioned about an aft closure plate or flange seating portion 58 located on the fuze well 32 of the warhead or penetrators. The fasteners 56 rigidly secure the flange 52 of the fuze 34 to the flange seating portion 58 of the fuze well 32. In this regard, the fasteners 56 enable the direct coupling of the fuze 34 with the fuze well 32 to eliminate or reduce mechanical amplification that would otherwise be caused by multiple mechanical interfaces, as described above with respect to conventional fuze mounting structures. With sufficient loading by the fasteners 56, the flange 52 and the flange seating portion 58 provide a nearly unitary connection that exhibits a substantially reduced susceptibility to mechanical amplification.

Optionally, the fuze types known as HTSF or MEHTF may be modified to incorporate the features of the invention. Specifically, an integral flange may be included with HTSF or MEHTF fuze types, for example, without limitation.

The fasteners 56 in this embodiment comprise threaded bolts having high tensile strength for exhibiting increased stiffness for improved vibration effects caused during impact or penetration shock. However, studs and nuts having similar mechanical properties may also be utilized to advantage. Moreover, it is envisioned that fasteners 56 may be of the type of a stud and jack-nut, or a jack-bolt as described in U.S. Pat. No. RE33490 and manufactured by the Superbolt Crop. of Carnegie, Pa. This type of fastener can be tightened by low torque tools while achieving high fastener tensions ideal for the fuze mounting 30, while providing improved assurance of proper fuze connection loading when in the field.

Optionally, a compression band 60 may be included between the outer surface 47 of the wall 46 and the front end 50 of the receiving well or port 31 of the fuze well 32. The compression band 60 may comprise an elastomer, such as a high density neoprene or may comprise a metal material (such term including alloys), for example, without limitation. The compression band 60 facilitates radial positioning of the fuze 34 within the fuze well 32, while providing shock isolation support in a radial or lateral direction from the interstitial gap that is formed between the receiving port 31 and the surface 47 of the wall 46 and is located toward the front end 50 of the fuze mounting 30. Also, not shown, one or more additional shock absorbing bands may be included aft of the optional compression band 60 to further reduce lateral shock in the fuze 34 and components therein.

FIG. 4 shows another fuze mounting 130 suitable for use with the invention. The fuze comprises a fuze 134 and a fuze well 132. The fuze 134 includes threads 135 located upon an outer surface 146 of a fuze housing 136 for cooperatively engaging a fuze well 132. The threads 135, together with bolts 156 and a flange 152, provide additional anchoring between the fuze 134 and the fuze well 132 and add additional support against impact and penetration shock induced mechanical amplification.

FIG. 5 shows yet another fuze mounting 230 suitable for use with the invention. As shown, a fuze 234 includes a compression wall 246 upon its fuze housing 236 for cooperatively engaging a surface of compression receiving port 231 of a fuze well 232, enabling a flange 252 of the fuze 234 to be securely fastened to the fuze well 232 by bolts 256. The compression wall 246 and the compression receiving port 231 need not have mating surfaces or inclinations, but it is anticipated that mating inclinations will provide for better anchoring between the fuze 234 and the haze well 232, reducing adverse effects caused by mechanical amplification from impact and penetration shock.

Figure 6:
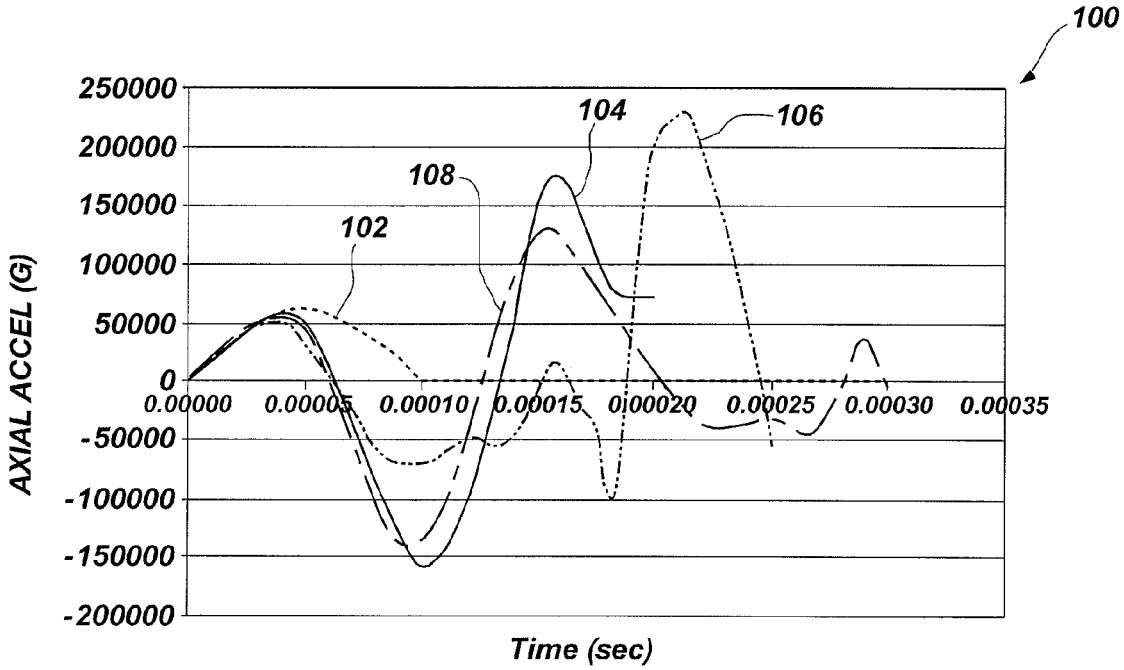
FIG. 6 is a graph of axial acceleration for three different fuze types in response to an input shock.

The performance improvement obtained through use of a fuze mounting is shown in FIG. 6 and Table 1 in order to show the added benefit of utilizing an embodiment of the invention with a fuze mounting heretofore described, for example, without limitation FIG. 6 is a graph 100 of axial acceleration for three different fuze types in response to an input shock 102. The graph 100 includes a vertical axis indicating axial acceleration in Gs, and a horizontal axis indicating elapsed time in seconds. The input shock 102 consists of a 60,000 G half-sine shock pulse for 100 microseconds applied in the axial direction for each fuze type. Response 104 is for an HTSF fuze configuration secured to the warhead or penetrator sandwiched by a fuze locking ring. Response 106 is for an MEHTF haze configuration secured to the warhead or penetrator sandwiched by a fuze locking ring. Response 108 is for a fuze mounting in accordance with an embodiment of the invention being secured to the warhead or penetrator with a bolted flange. Responses 114, 106 and 108 are as observed at the EFI location. As is shown in FIG. 6, improved mechanical amplification reduction, in comparison to conventional designs, is achieved by providing a bolted flange fuze mounting design to secure the fuze to the warhead or penetrator. The results are tabularized in Table 2, which shows the shock amplification for each fuze type mounting and component packaging

TABLE 2

Shock amplification of the fuze mounting/packaging.

| Fuze Type | Shock amplification of lead charge (unitless) |
|---|---|
| MEHTF | −1.3/+4.0 |
| HTSF | −2.7/+3.0 |
| Bolted flange with integral aft cover | −3.2/+2.6 |
| Bolted flange with integral front cover | −2.3/+2.2 |

The first set of numbers in each row of the shock amplification of lead charge column of Table 2 represents amplification of deceleration and the second set of numbers represents amplification of acceleration. As depicted, the conventional MEHTF fuze type is subject to 1.3 amplification of deceleration and is subjected to 4.0 amplification of acceleration due to the shock input. The conventional HTSF fuze type is subject to 2.7 amplification of deceleration and is subjected to 3.0 amplification of acceleration due to the shock input. In comparison, the bolted flange connection having an integral aft cover, as described above, is subjected to a lower 2.6 amplification of acceleration due to the shock input, while the bolted flange connection having an integral font cover has markedly improved 2.3 amplification of deceleration and a vastly improved 2.2 amplification of acceleration. Therefore, the fuze mounting exhibits an optimized amplification of acceleration that may advantageously be utilized with an embodiment of the invention. Accordingly, shock survivability of a fuze and a mounted acceleration sensor may be improved by minimizing mechanical amplification of impact and penetration shock.

Figure 7:
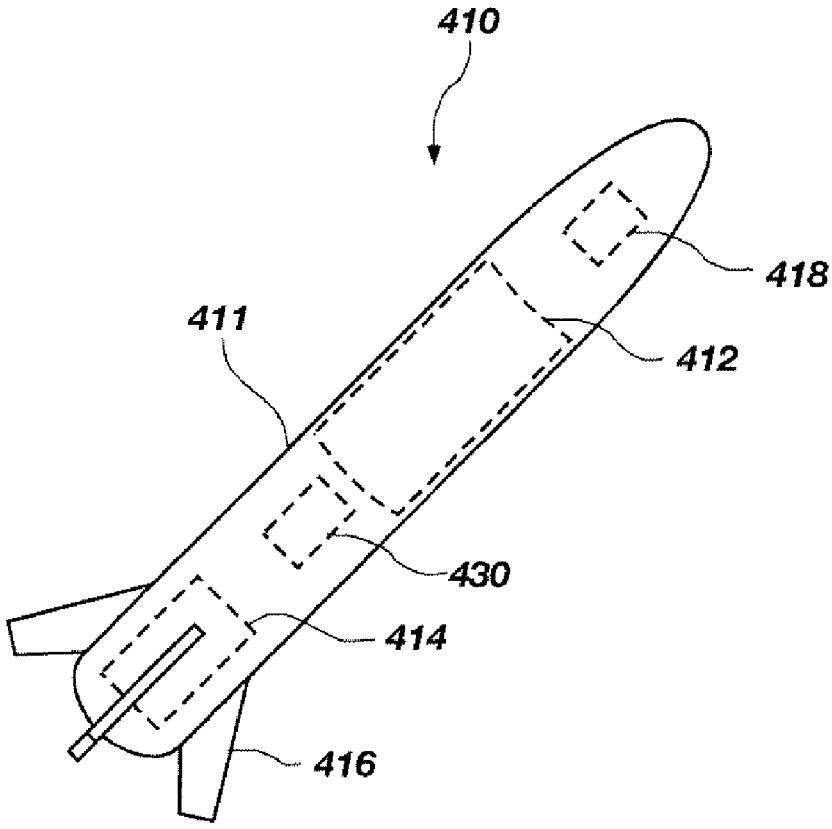
FIG. 7 shows a penetrating weapon configured as a projectable device having a novel fuze mounting assembly in accordance with the invention.

FIG. 7 shows a penetrating weapon configured as a projectable device 410 having a novel fuze assembly 430 in accordance with the invention. Desirably, the projectable device 410 will comprise a penetrating shell 411 and the novel fuze assembly 430 for igniting an explosive or other energetic material 412 when delivered to an intended target site. The projectable device 410 may optionally include one or more fins 416, a propulsion device 414 and a guidance system 418 for guiding the projectable device 410 to an intended target, as would be recognized by a person having skill in the art. However, it is recognized that the projectable device 410 need not necessarily be self-propelled, as it may be shot, launched or dropped toward an intended target.

While particular embodiments of the invention have been shown and described, numerous variations and alternate embodiments will occur to those skilled in the art. Accordingly, it is intended that the invention be limited in terms of the appended claims.

What is claimed is:

1. A fuze for a weapon configured as a projectable device, comprising:

a fuze well comprising a receiving port and a flange seating portion;

a fuze housing having an outer surface, and having a flange extending radially from the outer surface of the fuze, the flange having a recess therein; and an acceleration sensor coupled to the flange having a portion extending into the recess in the fuze housing.

2. The fuze of claim 1, wherein the flange and the fuze housing are of unitary construction.

3. The fuze of claim 1, further comprising an accelerometer mount, wherein the acceleration sensor is coupled to the accelerometer mount.

4. The fuze of claim 3, wherein the accelerometer mount is of unitary construction with the flange.

5. The fuze of claim 3, wherein the accelerometer mount is coupled to one face of the flange.

6. The fuze of claim 3, further comprising a mechanical filter for shock isolation of the acceleration sensor in the accelerometer mount.

7. The fuze of claim 1, further comprising a front end portion and an aft end portion, wherein the fuze housing includes a cylindrical wall including a first end and a second ends the front end portion coupled to the first end of the cylindrical wall, and the aft end portion coupled to the second end of the cylindrical wall, configured for fuze components so as to be securable in the fuze housing.

8. The fuze of claim 7, wherein one of the front end portion or the aft end portion forms a unitary construction with the fuze housing.

9. The fuze of claim 7, wherein the front end portion forms a unitary construction with the fuze housing.

10. The fuze of claim 7, wherein at least one of the front end portion and the aft end portion further includes at least one of openings and recesses therein.

11. The fuze of claim 1, wherein the acceleration sensor coupled to the flange is configured to exhibit an amplification of acceleration of less than 2.0 when subjected to impact and penetration shock response of a projectable device including the fuze contacting a target.

12. The fuze of claim 11, wherein the amplification of acceleration of less than 2.0 comprises an amplification of acceleration of less than 1.4.

13. The fuze of claim 11, wherein the amplification of acceleration of less than 2.0 comprises an amplification of acceleration of less than 1.0.

14. The fuze of claim 1, wherein the acceleration sensor coupled to the flange is configured to exhibit an amplification of deceleration of less than −1.3 and an amplification of acceleration of less than 2.0 when subjected to impact and penetration shock response of the projectable device including the fuze contacting a target.

15. The fuze of claim 14, wherein the amplification of deceleration of less than −1.3 and an amplification of acceleration of less than 2.0 comprises the amplification of deceleration of less than −1.4 and the amplification of acceleration of less than 1.4.

16. The fuze of claim 14, wherein the amplification of deceleration of less than −1.3 and an amplification of acceleration of less than 2.0 comprises the amplification of deceleration of less than −0.7 and the amplification of acceleration of less than 1.0.

17. The fuze of claim 1 wherein the outer surface of the fuze housing includes threads for cooperatively engaging threads located within a fuze well of the projectable device.

18. The fuze of claim 1, further comprising one or more axial holes extending through the flange.

19. A penetrating weapon configured as a projectable device comprising:

a penetrating shell:

an energetic material housed in the penetrating shell; and a fuze assembly coupled to the penetrating shell in operable communication with the energetic material, the fuze assembly comprising:

a fuze well comprising a receiving port and a flange seating portion;

a fuze comprising a fuze housing and a flange extending radially from an outer surface thereof, the flange having a recess therein, the fuze housing of the fuze received in the receiving port of the fuze well, and the flange of the fuze housing coupled to the flange seating portion of the fuze well; and an acceleration sensor coupled to the flange of the fuze having a portion extending into the recess in the fuze housing.

20. The penetrating weapon of claim 19, wherein:

the flange includes a plurality of holes extending therethrough;

the flange seating portion includes a plurality of fastener receiving locations aligned with the plurality of holes; and a plurality of fasteners extending through the plurality of holes and into the plurality of fastener receiving locations.

21. The penetrating weapon of claim 19, further comprising a propulsion device.

22. The penetrating weapon of claim 19, further comprising a guidance system.

23. The penetrating weapon of claim 19, wherein the acceleration sensor is mounted so as to exhibit an amplification of acceleration of less than 2.0 when subjected to impact and penetration shock responsive to the penetrating weapon projectable device contacting a target.

24. The penetrating weapon of claim 19, wherein the flange is integral with the fuze housing.

25. The penetrating weapon of claim 19, farther comprising an accelerometer mount coupled to the flange, wherein the acceleration sensor is coupled to the accelerometer mount.

26. The penetrating weapon of claim 25, wherein the accelerometer mount and the flange are unitary.

27. The penetrating weapon of claim 26, further comprising a mechanical filter coupled to the accelerometer mount for shock isolation of the acceleration sensor.

28. The penetrating weapon of claim 19, wherein the flange comprises one or more axial hole extending therethrough.

29. The penetrating weapon of claim 19, wherein the fuze further comprises:

a front end portion and an aft end portion;

the fuze housing includes a cylindrical wall including a first end and a second end, the front end portion coupled to the first end of the cylindrical wall, and the aft end portion coupled to the second end of the cylindrical wall, configured for fuze components so as to be securable in the fuze housing.

30. The penetrating weapon of claim 19, wherein the acceleration sensor is mounted so as to exhibit an amplification of deceleration of less than −1.3 and an amplification of acceleration of less than 2.0 when subjected to impact and penetration shock response of a projectable device including the fuze contacting a target.

31. The penetrating weapon of claim 19, wherein an outer surface of the fuze housing includes threads for cooperatively engaging threads located within the receiving port of the fuze well.

* * * * *

UNITED STATES PATENT AND TRADEMARK OFFICE

CERTIFICATE OF CORRECTION

PATENT NO. : 7,552,682 B2
APPLICATION NO. : 11/613497
DATED : June 30, 2009
INVENTOR(S) : Stanley N. Schwantes, Bradley M. Biggs and Michael A. Johnson It is certified that error appears in the above-identified patent and that said Letters Patent is hereby corrected as shown below:

On the title page:

In ITEM (75) Inventors: change "Sahuarita," to --Corona,--

In the claims:

CLAIM 7, COLUMN 12, LINE 11, change "ends" to --end,--

Signed and Sealed this
Twenty-first Day of May, 2013

Teresa Stanek Rea

Teresa Stanek Rea
*Acting Director of the United States Patent and Trademark Office*